US007934932B1

(12) United States Patent
Lee et al.

(10) Patent No.: US 7,934,932 B1
(45) Date of Patent: May 3, 2011

(54) ELECTRICAL POWER RECEPTACLE DEVICE

(75) Inventors: Yu-Lung Lee, Nanjhuang Township, Miaoli County (TW); Jung-Hui Hsu, Sinjhuang (TW); Ming-Chou Kuo, Taipei (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 12/759,145

(22) Filed: Apr. 13, 2010

(30) Foreign Application Priority Data

Jan. 27, 2010 (TW) ..... 99102286 A

(51) Int. Cl.
*H01R 39/00* (2006.01)

(52) U.S. Cl. ..... 439/31; 439/654; 439/214; 439/131

(58) Field of Classification Search ..... 439/654, 439/652, 640, 31, 11, 638, 214, 131
See application file for complete search history.

(56) References Cited

U.S. PATENT DOCUMENTS 2,652,546 A * 9/1953 Christner ..... 439/8
7,374,425 B1 * 5/2008 Kuo et al. ..... 439/31

* cited by examiner

*Primary Examiner* — Javaid Nasri
(74) *Attorney, Agent, or Firm* — Kile Goekjian Reed & McManus PLLC

(57) ABSTRACT

Disclosed is an electrical power receptacle device, comprising: a main body, a dual-sided power socket, and a flip unit, wherein, the main body has a retaining wall. The dual-sided power socket is disposed in the accommodating space. The flip unit couples to the main body and the dual-sided power socket for providing the dual-sided power socket to be flipped to an open position or to a close position on the main body, wherein, as the dual-sided power socket is flipped to the open position, the dual-sided power socket is facilitated to be fixed and maintained in the open position on the main body by the retaining wall.

7 Claims, 8 Drawing Sheets

ELECTRICAL POWER RECEPTACLE DEVICE

BACKGROUND OF THE INVENTION

1. Field of the Invention

The present invention relates to an electrical power receptacle device, in particular, to an electrical power receptacle device which has a main body and a dual-sided power socket, in which the dual-sided power socket is capable of rotating or flipping on the main body.

2. Description of Related Art

Generally speaking, a conventional single side extension power socket (not labeled) is configured with a plurality of electrical outlets disposed and sequentially arranged on a surface. An overall length and volume of the single side extension power socket must be lengthened and extended if the configuration design according to the prior art is utilized to produce a single side extension power socket having more electrical outlets. As such, the single side extension power socket in use occupies larger space.

In view of the aforementioned issue, a dual-sided extension power socket is released as shown in FIG. 1, in which an exploded diagram of the dual-sided extension power socket according to the prior art is demonstrated. A dual-sided extension power socket 1 has disposed and arranged a plurality of electrical outlets 10 sequentially on different surfaces respectively, such that a plurality of electrical plugs 2 can be applied and plugged into the electrical outlets 10 configured on both sides of the dual-sided extension power socket 1. As a result, under the condition that quantity of the plurality of electrical outlets 10 and the single side extension power socket of the prior art are exactly same, the overall volume of the dual-sided extension power socket 1 is obviously smaller than the single side extension power socket, thereby providing convenience for transportation and collection without occupying more space.

Yet, an outer shape structure of the dual-sided extension power socket 1 is usually not capable of altering based on different environments. Therefore, the dual-sided extension power socket 1 applied in a harsh environment may limit the utilization of the electrical outlets 10, such that all of the electrical outlets 10 may not be used. Moreover, the dual-sided extension power socket 1 is usually placed on the ground. If the ground is getting damp or wet, it may result in power leakage or short circuit circumstances occurred for the dual-sided extension power socket 1, thereby endangering users.

SUMMARY OF THE INVENTION

In view of the aforementioned issues, the present invention provides an electrical power receptacle device which has a dual-sided power socket and a main body. The dual-sided power socket is capable of rotating or flipping on the main body.

To solve the aforementioned issues, an embodiment of an electrical power receptacle device according to the present invention, comprising: a main body, a dual-sided power socket, and a flip unit, wherein, the main body has a retaining wall. Two sides of the dual-sided power socket have configured with a plurality of electrical outlets. The flip unit couples to the main body and the dual-sided power socket for providing the dual-sided power socket to be flipped to an open position or to a close position on the main body, wherein, as the dual-sided power socket is flipped to the open position, the dual-sided power socket is facilitated to be fixed and maintained in the open position on the main body by the retaining wall.

Therefore through the aforementioned technical proposal of the present invention, the dual-sided power socket may be flipped from the main body to the open position or be flipped back to the close position on the main body by means of the flip unit. The outer shape structure of the electrical power receptacle device in accordance with certain aspects of the present invention may be changed associated with different environments. Meanwhile, the dual-sided power socket is disposed on the main body not connected to the ground directly, so that power leakage or short circuit circumstances due to water on the ground may be prevented.

DETAILED DESCRIPTION OF THE PREFERRED EMBODIMENTS

Figure 1:
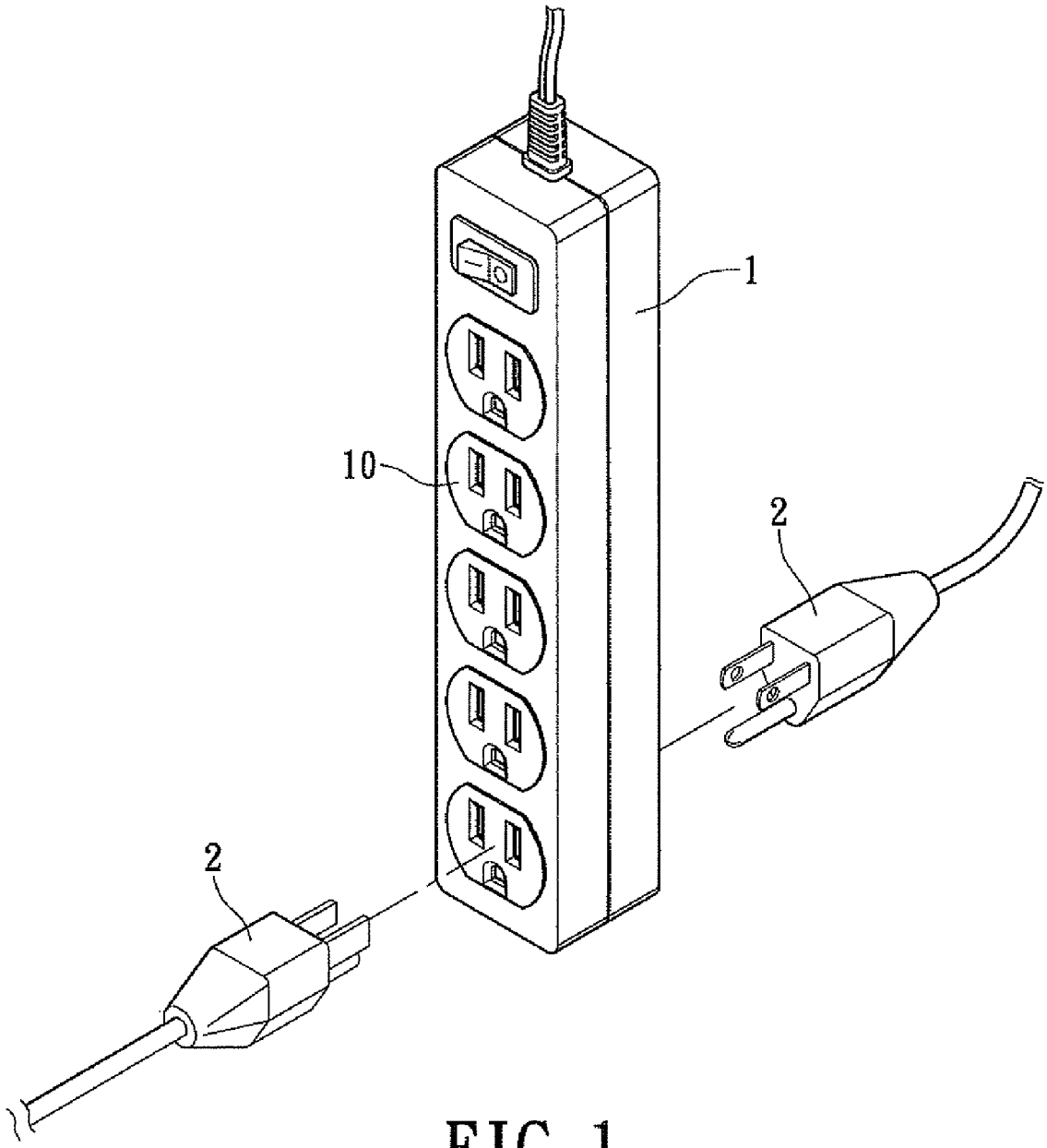
FIG. 1 PRIOR ART
FIG. 1 illustrates an exploded diagram of a dual-sided extension power socket according to the prior art.
Figure 2:
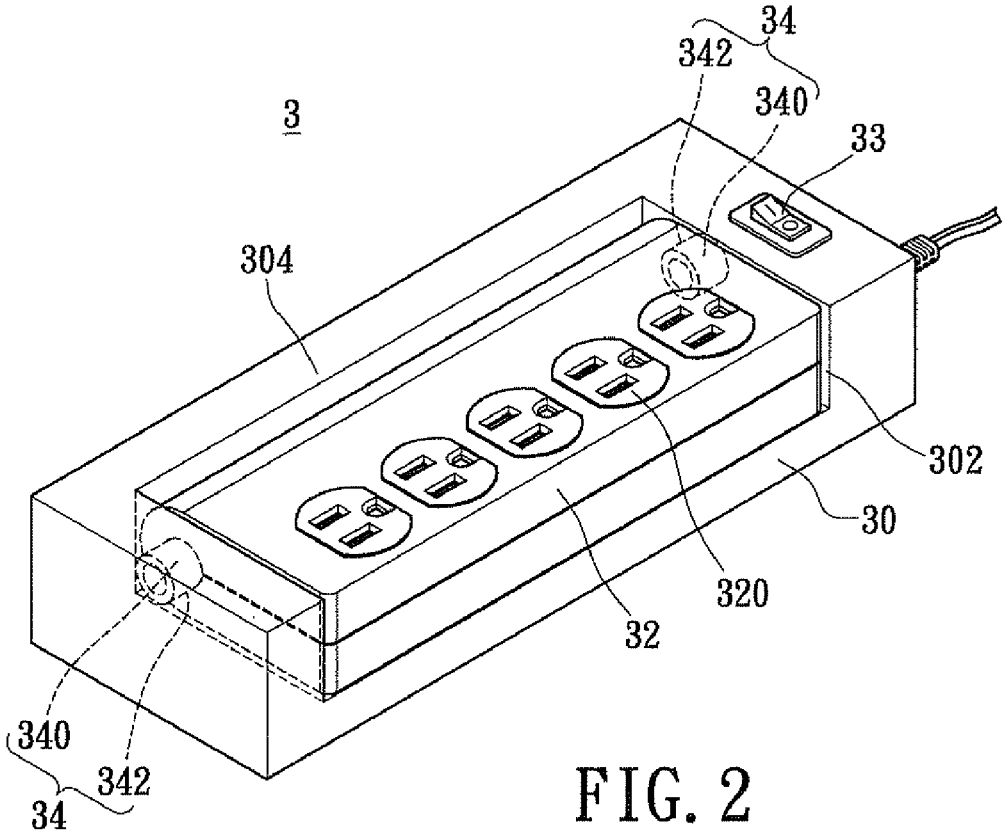
FIG. 2 illustrates an exploded diagram of a first embodiment in accordance with the electrical power receptacle device according to the present invention.

Please refer to FIG. 2, in which an exploded diagram of a first embodiment in accordance with the electrical power receptacle device according to the present invention is demonstrated. An electrical power receptacle device 3 has a main body 30, comprising an accommodating space 302 and a retaining wall 304. Herein the accommodating space 302 is perfectly available to receive a dual-sided power socket 32. The dual-sided power socket 32 and the main body 30 are coupled to each other by means of pivot connection, hinge connection, or other equivalent techniques.

Refer to FIG. 2 again. A flip unit 34 of the electrical power receptacle device 3 is adapted as a connecting element between the main body 30 and the dual-sided power socket 32 and is a critical member for allowing the dual-sided power socket 32 to be movable on the main body 30. the main body 30 of the electrical power receptacle device 3 is electrically connected to the public electrical power distribution system (not shown), and meanwhile, the main body and the dual-sided power socket are also electrically connected with each other, Additionally, a plurality of electrical outlets 320 are sequentially arranged on the two surfaces which are opposite with each other. The flip unit 34 coupled to the main body 30 and the dual-sided power socket 32 may facilitate the dual-sided power socket 32 to be flipped out from the accommodating space 302 or to be received into the accommodating space 302. Wherein, as the dual-sided power socket 32 is flipped out of the main body 30, the dual-sided power socket 32 is maintained and fixed in an open position on the main body 30 by the retaining wall 304.

The retaining wall 304 formed on a side surface of the accommodating space 302 is merely used as an embodiment for illustration, but is not limited thereto. Thus, any technical means which are capable of allowing the dual-sided power socket 32 to be flipped out of the main body 30 and positioned on the main body 30 are all consequently viewed as being embraced by the scope of the present invention. The aforementioned electrical power receptacle device 3 may be of an extension power socket type or a wall-tap type.

The dual-sided power socket 32 of the electrical power receptacle device 3 may be capable of rotating or flipping on the main body 30. As the dual-sided power socket 32 is received into the accommodating space 302, the dual-sided power socket 32 only provides some of electrical outlets 320 configured on a single exposed surface for use of external electrical plugs. Additionally, as the quantity of the external electrical plugs are increasing and the number of the electrical outlets configured on the single side is not enough, the dual-sided power socket 32 may be flipped out from the accommodating space 302 and be blocked by the retaining wall 302, so as to be positioned on the main body 30, so that the electrical outlets 320 disposed on the double exposed surfaces may be available for use of external electrical plugs (not labeled).

Consequently, as the electrical power receptacle device 3 is in use, if the number of the electrical outlets 320 required is enough, the dual-sided power socket 32 may be maintained in a close position in the accommodating space 203 without flipping or rotating. If it is required to increase the number of the electrical outlets, it only required to flip and rotate the dual-sided power socket 32 to an open position, the electrical power receptacle device 3 may immediately have two times of the amount of the electrical outlets 320. Further, the dual-sided power socket 32 of the electrical power receptacle device 3 is disposed on the main body 30, not contacted to the ground directly, thereby preventing power leakage or short circuit circumstances occurred due to humidity or water on the ground. In addition, the production cost of the electrical power receptacle device 3 does not increase too much compared to the conventional dual-sided extension power socket.

The electrical power receptacle device 3 may further dispose a power switch 33 as shown in FIG. 2. The power switch 33 may be disposed inside the main body 30 or the dual-sided power socket 32. In accordance with the operations of the power switch 22, the dual-sided power socket 32 may be controlled to be either in a conduction state or in a cutoff state. Furthermore, the plurality of electrical outlets 320 of the dual-sided power socket 32 may be configured on surfaces opposite with each other or surfaces adjacent to each other. The electrical outlets 320 may be of two-hole outlets, three-hole outlets, or models with different standards or specifications.

Figure 3A:
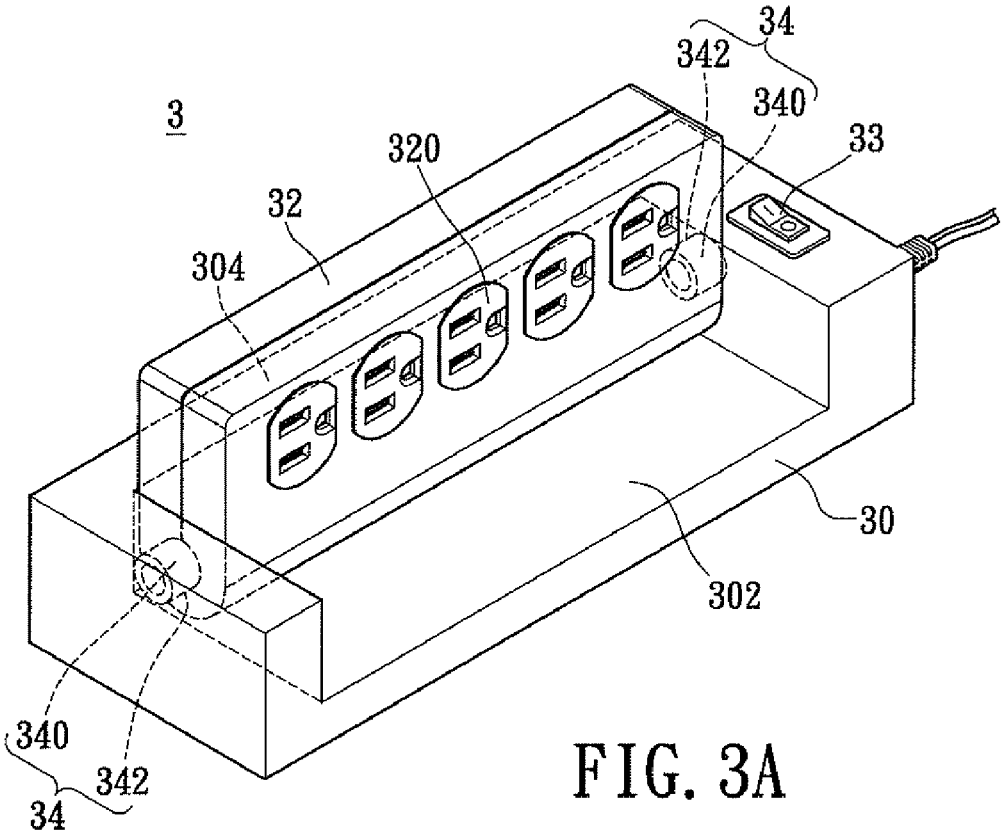
FIG. 3A illustrates an exploded diagram of the first embodiment in accordance with the electrical power receptacle device according to the present invention.
Figure 3B:
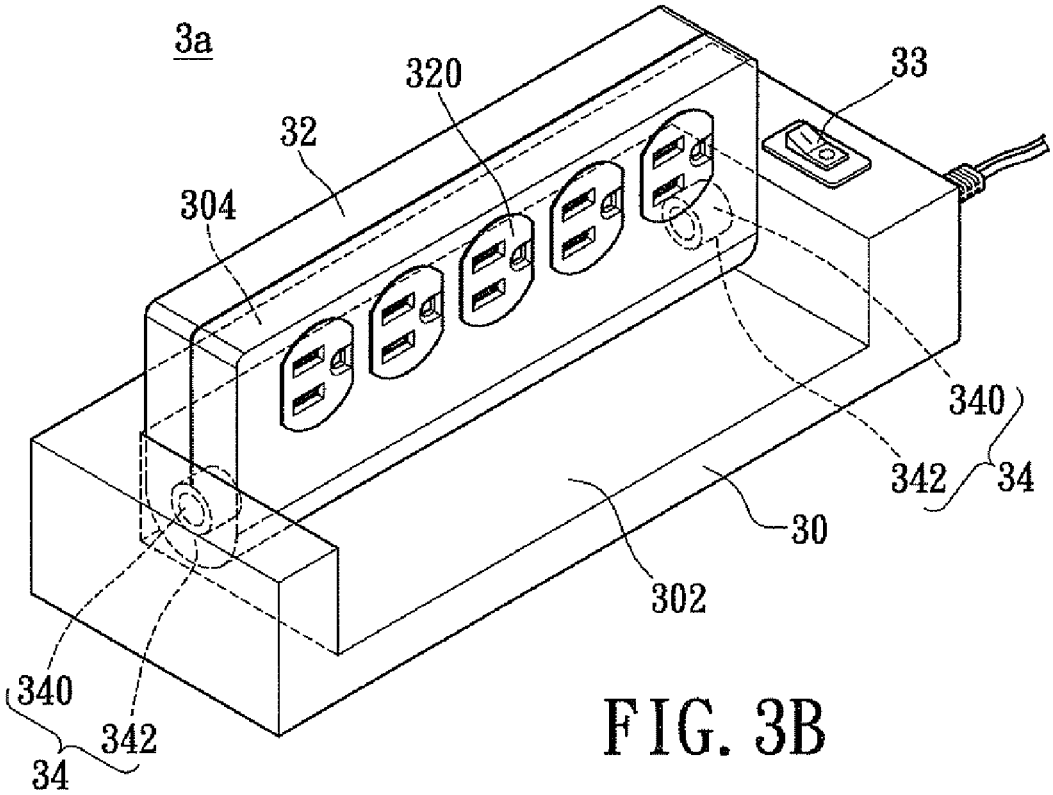
FIG. 3B illustrates an exploded diagram of a second embodiment in accordance with the electrical power receptacle device according to the present invention.

Next, please refer to FIG. 3A, in which an exploded diagram of the first embodiment in accordance with the electrical power receptacle device according to the present invention is demonstrated. The flip unit 34 of the electrical power receptacle device 3 comprises two fixed shafts 340 and two shaft positioning holes 342, wherein the two fixed shafts 340 are coupled to the two shaft positioning holes 342, correspondingly. As such, the dual-sided power socket 32 may be flipped outward from the accommodating space 302 or flipped toward the accommodating space 302 with respect to the operations of the flip unit 34. As shown in FIG. 3A, two fixed shafts 340 of the flip unit 34 are respectively disposed on two ends of the main body 30, wherein the two shaft positioning holes 342 are disposed on two ends of the dual-sided power socket 32 aligned with the two fixed shafts 340. Additionally, as shown in FIG. 3B, two fixed shafts 340 of the flip unit 34 associated with the electrical power receptacle device 3*a* may be disposed on two ends of the dual-sided power socket 32, wherein the two shaft positioning holes 342 are disposed on two ends of the main body 30 aligned with the two fixed shafts 340 for providing similar operations as per FIG. 3A. FIG. 3B is an exploded diagram of a second embodiment in accordance with the electrical power receptacle device according to the present invention.

Figure 3C:
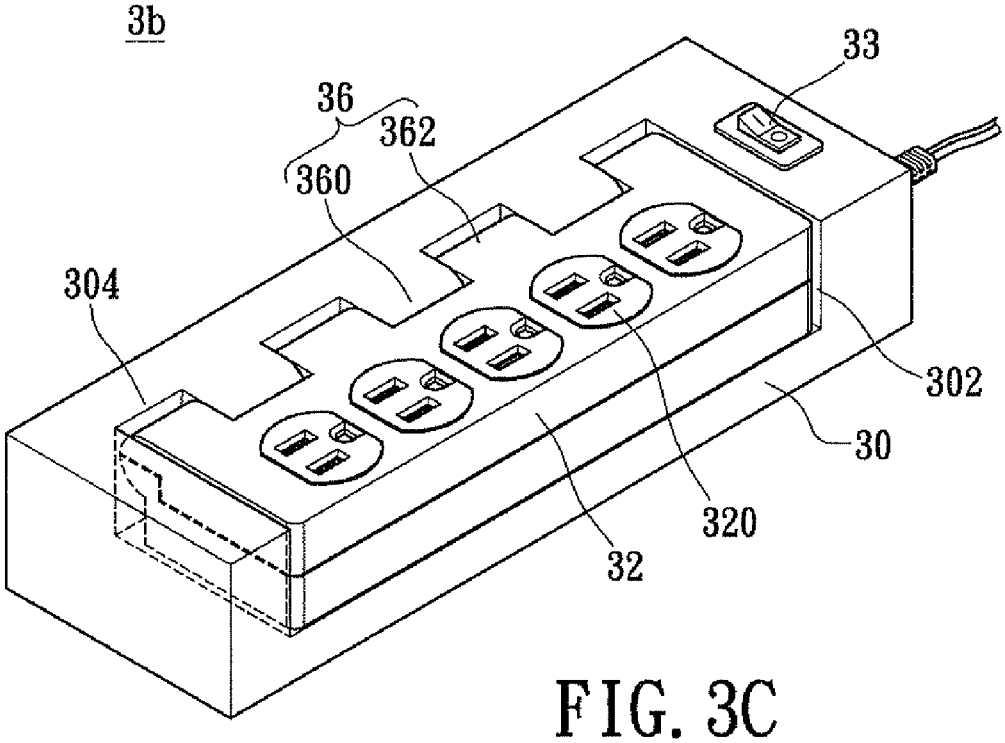
FIG. 3C illustrates an exploded diagram of a third embodiment in accordance with the electrical power receptacle device according to the present invention.

Please refer to FIG. 3C, in which an exploded diagram of a third embodiment in accordance with the electrical power receptacle device according to the present invention is demonstrated. A flip unit 36 of an electrical power receptacle device 3*b* may be of a hinge. A first side of the flip unit 360 connects to the main body 30, and the second side of the flip unit 362 connects to the dual-sided power socket 32. Therefore, the dual-sided power sockets 32 may be flipped outward or inward the accommodating space 302 by means of the flip unit 36.

Figure 4A:
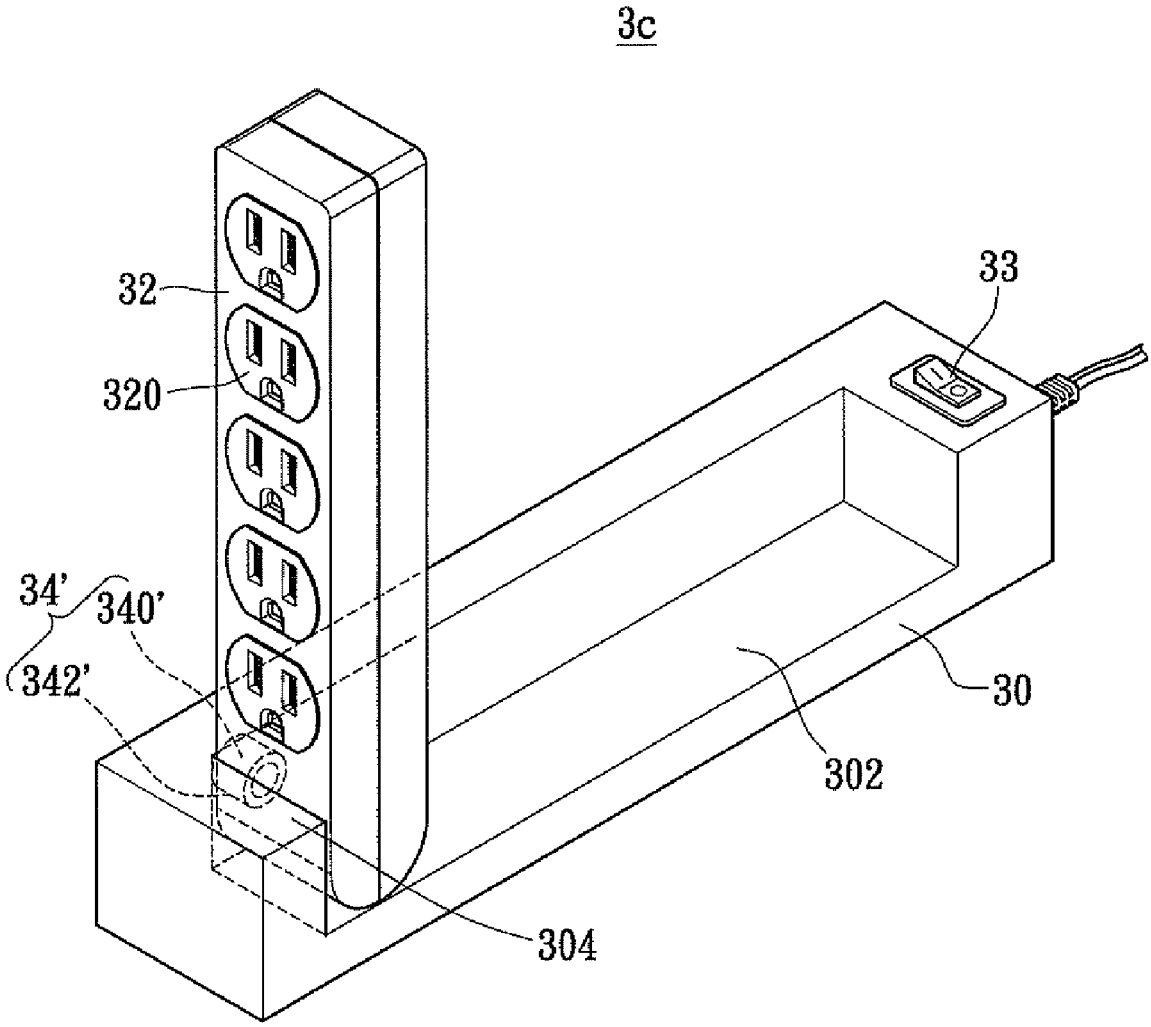
FIG. 4A illustrates an exploded diagram of a fourth embodiment in accordance with the electrical power receptacle device according to the present invention.

Please refer to FIG. 4A, in which an exploded diagram of a fourth embodiment in accordance with the electrical power receptacle device according to the present invention is demonstrated. A flip unit 34' of an electrical power receptacle device 3*c* includes a fixed shaft 340' and a shaft positioning hole 342', wherein, the fixed shaft 340' pivoted to the shaft positioning hole 342'. As such, the dual-sided power sockets 32 may be flipped outward or inward the accommodating space 302 by means of the flip unit 34'. The fixed shaft 340' of the flip unit 34' as shown in FIG. 4A may be disposed on one end of the main body 30, wherein the shaft positioning hole 342' is disposed on one end of the dual-sided power socket 32 which is aligned to the fixed shaft 340'.

Figure 4B:
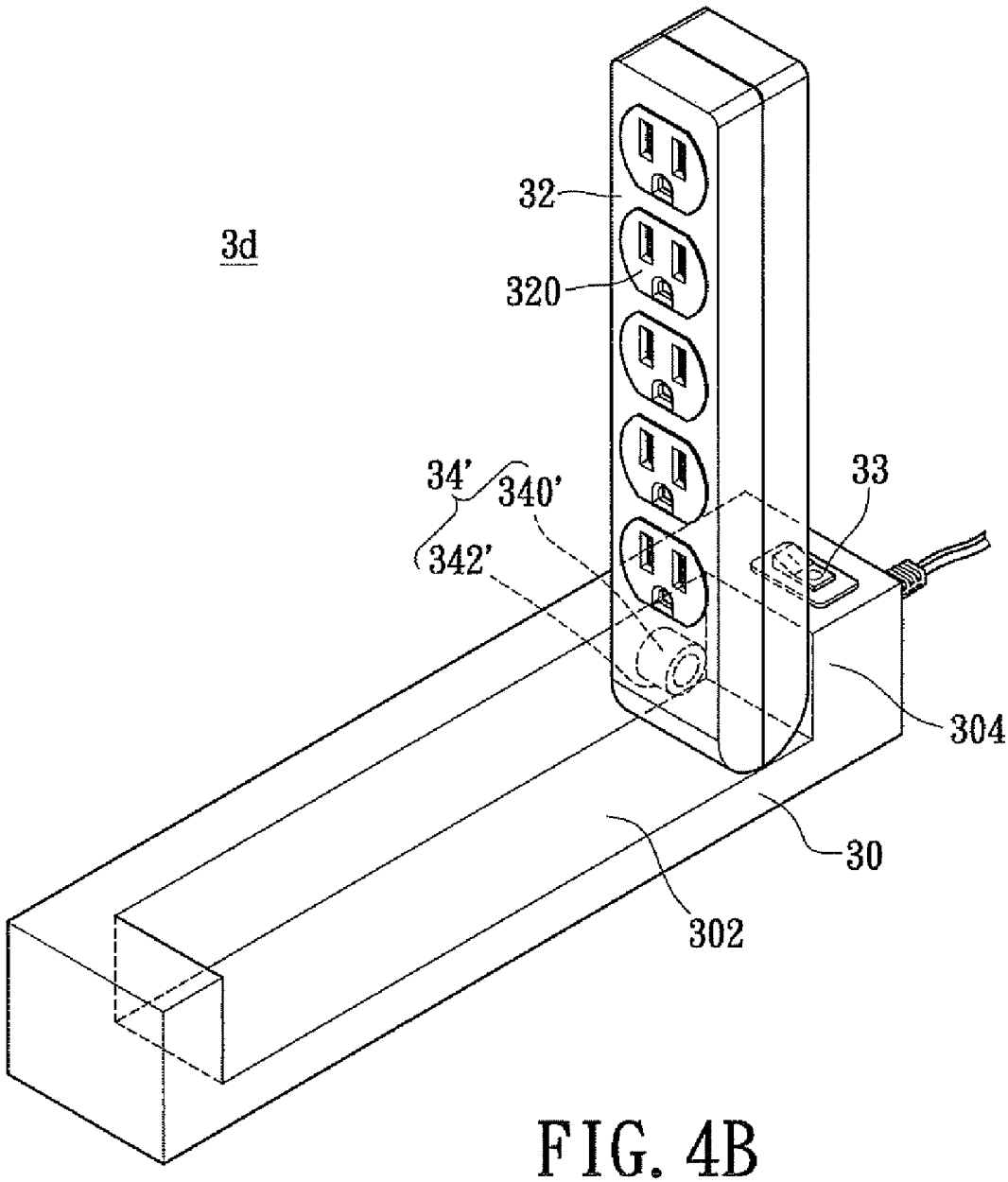
FIG. 4B illustrates an exploded diagram of a fifth embodiment in accordance with the electrical power receptacle device according to the present invention.

Additionally, please refer to FIG. 4B, in which an exploded diagram of a fifth embodiment in accordance with the electrical power receptacle device according to the present invention is demonstrated. The fixed shaft 340' of the flip unit 34; associated with an electrical power receptacle device 3*d* may be disposed on a side of the dual-sided power socket 32, wherein the shaft positioning hole 342' may be disposed on a side of the train body aligned to the fixed shaft 340' for providing similar operations as per FIG. 4A.

Figure 4C:
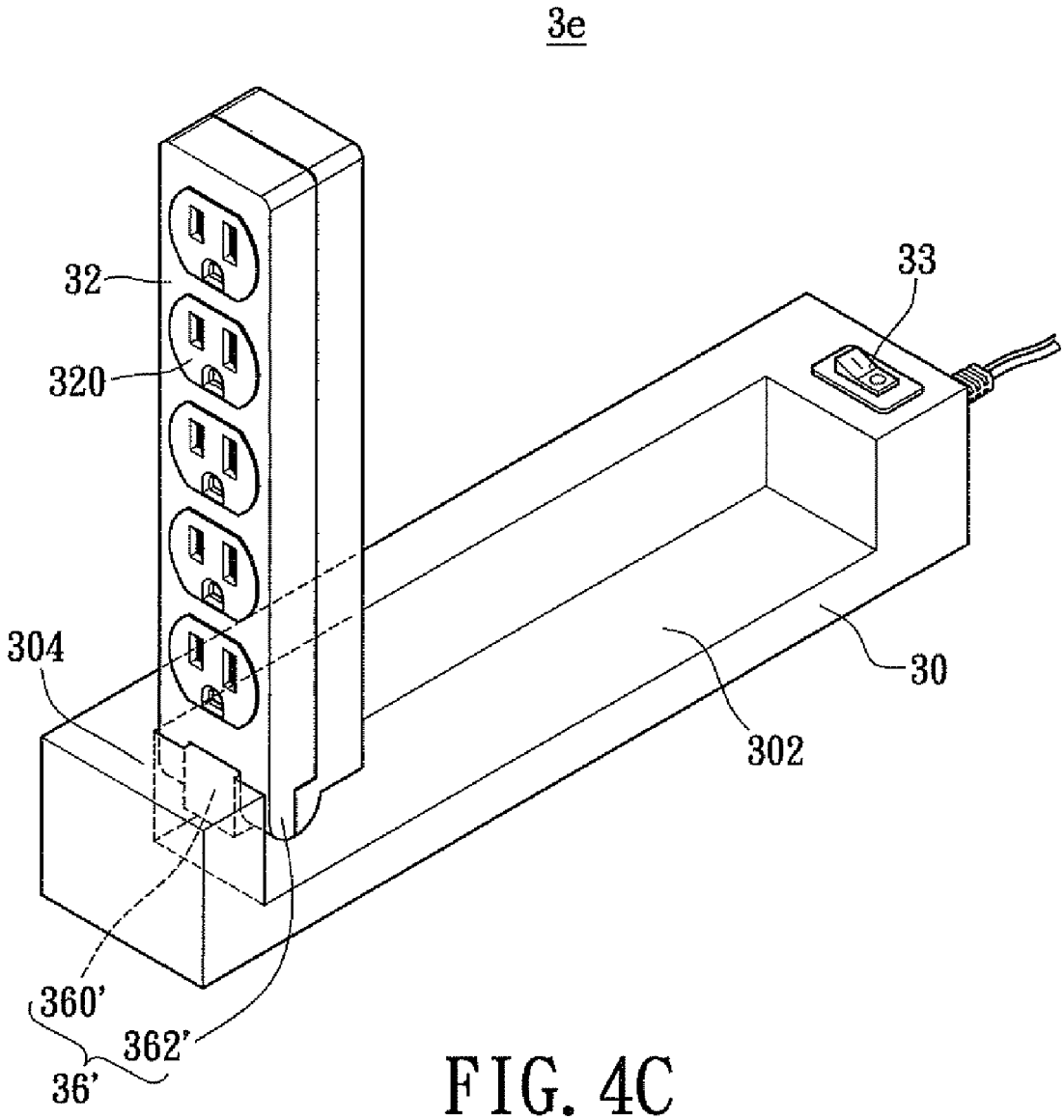
FIG. 4C illustrates an exploded diagram of a sixth embodiment in accordance with the electrical power receptacle device according to the present invention.

Next, please refer to FIG. 4C, in which an exploded diagram of a sixth embodiment in accordance with the electrical power receptacle device according to the present invention is demonstrated. A flip unit 36' of an electrical power receptacle device 3*e* may be of a hinge. A first side of the flip unit 360' connects to a side of the main body 30, and a second side of the flip unit 362' connects to a side of the dual-sided power socket 32. Consequently, the dual-sided power sockets 32 may be flipped outward or inward the accommodating space 302 by means of the flip unit 36'.

Figure 4D:
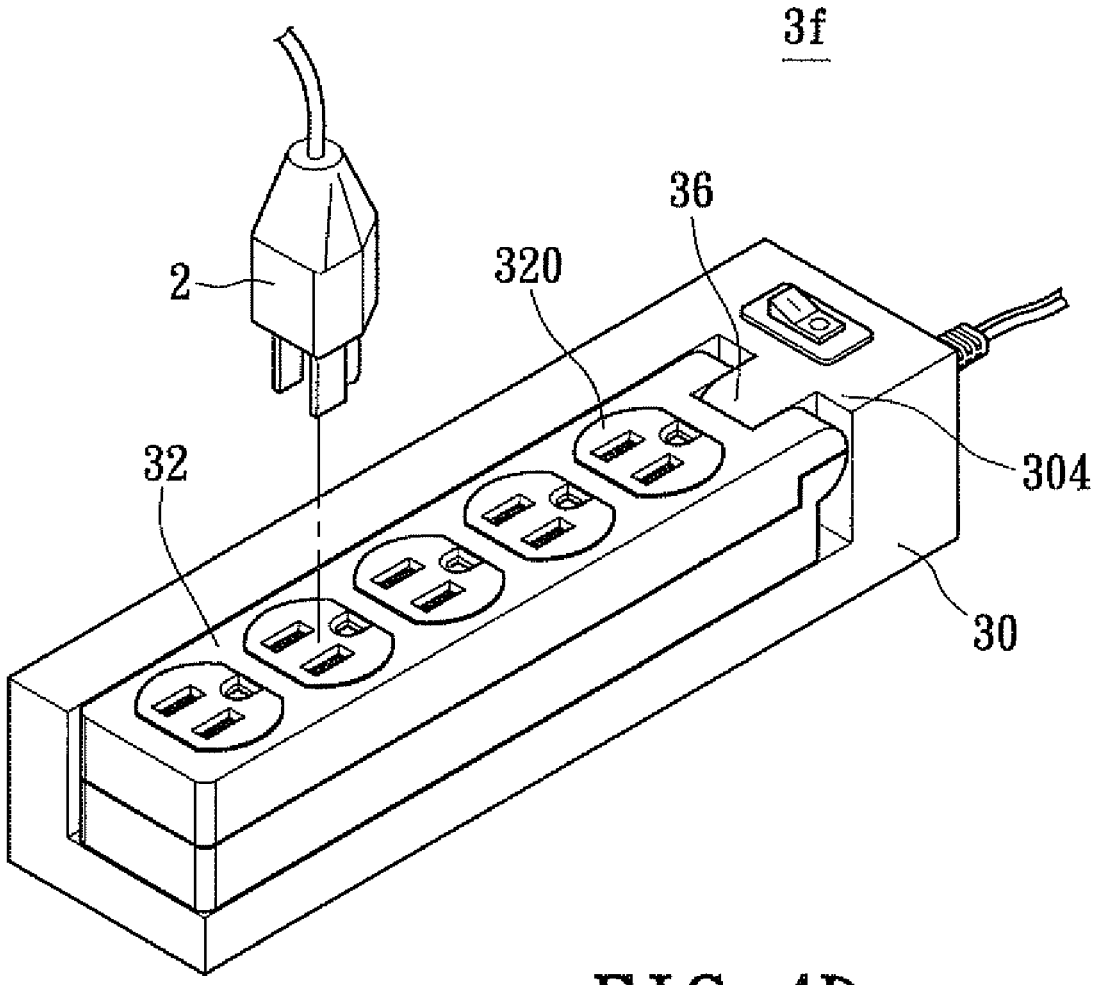
FIG. 4D illustrates an exploded diagram of a seventh embodiment in accordance with the electrical power receptacle device according to the present invention in a seventh mode of application.

Please refer to FIG. 4D in conjunction with FIG. 4C, in which an exploded diagram of a seventh embodiment in accordance with the electrical power receptacle device according to the present invention is demonstrated. The critical difference between FIG. 4C and FIG. 4D is: the electrical power receptacle device 3*e* shown in FIG. 4C is of a C-shaped body, yet, an electrical power receptacle device 3*f* shown in FIG. 4D is of a L-shaped body.

Figure 5:
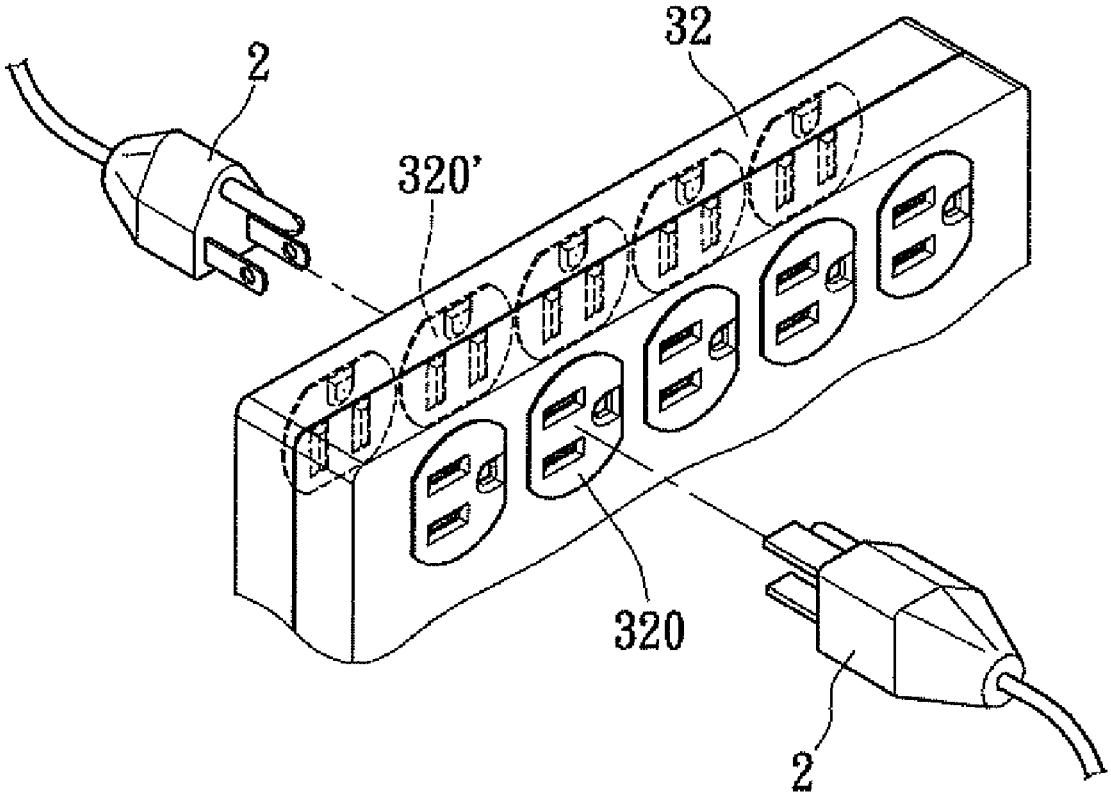
FIG. 5 illustrates an exploded diagram of a dual-sided power socket in accordance with certain aspects of the present invention.

Please refer to FIG. 5, in which an exploded diagram of a dual-sided power socket in accordance with certain aspects of the present invention is demonstrated. As per the aforementioned embodiments, the plurality of electrical outlets 320, 320' of the dual-sided power socket 32 may be configured on surfaces opposite with each other or surfaces adjacent to each other. The orientation of the electrical outlets 320 may be arranged in a 180 degree direction. The orientation of the electrical outlets 320' may be arranged in a 90 degree direction. The electrical outlets 320, 320' may be of two-hole outlets, three-hole outlets, or models with different standards or specifications.

In the aspects of the aforementioned embodiments, the technical characteristics of the electrical power receptacle device according to the present invention are utilized to flip or rotate the dual-sided power socket out of the main body or toward the main body by means of the flip unit. Hence, the outer shape configuration of the electrical power receptacle device may be altered in accordance with different environments. Meanwhile, the duals-surface power socket is configured on the main body, but contacted to the ground directly, thereby preventing power leakage or short circuit problems due to humanity or water on the ground.

The aforementioned descriptions represent merely the preferred embodiment of the present invention, without any intention to limit the scope of the present invention thereto. Various equivalent changes, alterations, or modifications based on the claims of present invention are all consequently viewed as being embraced by the scope of the present invention.

What is claimed is:

1. An electrical power receptacle device, comprising:

a main body, having a retaining wall;

a dual-sided power socket having a plurality of electrical outlets on two surfaces of the dual-sided power socket; and a flip unit, coupled to the main body and the dual-sided power socket, for enabling the dual-sided power socket to be flipped to an open position or to a close position on the main body, wherein, as the dual-sided power socket is flipped to the open position, the dual-sided power socket is caused to be maintained at the open position on the main body by the retaining wall before being flipped to the close position.

2. The electrical power receptacle device according to claim 1, wherein the main body includes an accommodating space which is used to receive the dual-sided power socket.

3. The electrical power receptacle device according to claim 2, wherein the flip unit facilitates the dual-sided power socket to be flipped or rotated to the open position on the accommodating space vertically for exposing the plurality of electrical outlets disposing on the two surfaces of the dual-sided power socket, or to be flipped to the close position in the accommodating space for exposing the electrical outlets disposing on one surface of the dual-sided power socket.

4. The electrical power receptacle device according to claim 3, wherein the flip unit includes a fixed shaft disposed on the main body and a shaft positioning hole disposed on the dual-sided power socket, for coupling the main body and the dual-sided power socket with each other.

5. The electrical power receptacle device according to claim 3, wherein the flip unit includes a fixed shaft disposed on the dual-sided power socket and a shaft positioning hole disposed on the main body, for coupling the main body and the dual-sided power socket to each other.

6. The electrical power receptacle device according to claim 3, wherein the flip unit is a hinge, having a first end connected to the main body and a second end connected to the dual-sided power socket.

7. The electrical power receptacle device according to claim 3, further including a power switch, being disposed on the main body or the dual-sided power socket for controlling the dual-sided power socket to be in a conduction state or in a cutoff state, wherein the dual-sided power socket is electrically connected to the main body.

* * * * *